US005209194A

United States Patent [19]

Adachi et al.

[11] Patent Number: 5,209,194

[45] Date of Patent: May 11, 1993

[54] VARIABLE VALVE TIMING APPARATUS

[75] Inventors: Michio Adachi, Obu; Haruyuki Obata, Toyota, both of Japan

[73] Assignee: Nippondenso Co., Ltd., Kariya, Japan

[21] Appl. No.: 872,392

[22] Filed: Apr. 23, 1992

[30] Foreign Application Priority Data

Apr. 26, 1991 [JP] Japan ..... 3-96977
Feb. 28, 1992 [JP] Japan ..... 4-42796

[51] Int. Cl.[5] ..... F01L 1/34

[52] U.S. Cl. ..... 123/90.17; 123/90.31; 464/2; 74/568 R

[58] Field of Search ..... 123/90.15, 90.17, 90.31; 464/1, 2, 160; 74/568 R, 567

[56] References Cited

U.S. PATENT DOCUMENTS 4,305,352 12/1981 Oshima et al. ..... 123/90.15
4,463,712 8/1984 Stojek et al. ..... 123/90.17
4,976,229 12/1990 Charles ..... 123/90.17
4,986,801 1/1991 Ohlendorf et al. ..... 123/90.17

FOREIGN PATENT DOCUMENTS 60243308 12/1985 Japan ..... 123/90.17

*Primary Examiner*—E. Rollins Cross
*Assistant Examiner*—Weilun Lo
*Attorney, Agent, or Firm*—Cushman, Darby & Cushman

[57] ABSTRACT

An apparatus for controlling a valve timing in an internal combustion engine. A timing piston 7 is in splined engagement with both a camshaft sleeve connected to the camshaft 1 and a pulley sleeve connected to the timing pulley. The timing piston 7 is connected, via a ball bearing unit 8, to a screw nut 9 of a ball screw mechanism. The bearing unit 8 is connected to the nut 9, with a clearance C. A disk spring 20, via a spacer 21, urges the inner race 8a of the bearing 8 so that it abuts against a washer 23 an a snap ring 22 on the screw shaft 9. As a result, the screw shaft 9 is connected to the timing piston 7 so that the axial movement from the shaft 9 is transmitted to the piston 7, while the piston 7 is rotating on the shaft 9, and a slight radial relative movement is allowed between the screw shaft 9 and the piston 7 without generating any play in the axial movement. An oil passageway is formed for lubricating the ball nut mechanism.

26 Claims, 9 Drawing Sheets

VARIABLE VALVE TIMING APPARATUS

BACKGROUND OF THE INVENTION

1. Field of the Invention

The present invention relates an apparatus for controlling a valve timing in an internal combustion engine, wherein the opening or closing timing of an intake or exhaust valve is suitably controlled in accordance with engine operating conditions.

2. Description of Related Art

Japanese Unexamined Patent Publication No. 60-243308 discloses a mechanism for controlling a rotating phase difference between a camshaft and a crankshaft in an internal combustion engine, the mechanism being provided with a first helical splined shaft fixed to the camshaft and defining on an outer surface thereof a helical spline, a second helical splined shaft fixed to a timing pulley of the camshaft and connected by a belt to a timing pulley fixed to a crankshaft and defining on an outer surface thereof a helical spline, and a timing piston having a spline which is in mesh with the helical splines of the first and second helical splined shafts. The timing piston is connected to a mechanism for obtaining a movement of the timing shaft in parallel to the direction of the axis of the camshaft, to thereby cause the first and second helical splined shafts to be relatively rotated, and thus allow a rotational phase difference to be obtained between the timing pulley, connected to the crankshaft via a belt-pulley mechanism, and the camshaft. The mechanism for obtaining the movement of the timing piston is constructed by an electric motor for obtaining a rotational movement, and a mechanism, such as a ball nut, for transforming the rotational movement from the motor to a linear movement in parallel to the direction of the camshaft. The mechanism for transforming the rotational movement into a linear movement comprises a worm member on an output shaft of the electric motor, a pinion in mesh with the worm, a first slider sleeve defining at an outer surface thereof a gear portion in mesh with the pinion, a second slider sleeve in screw engagement with the first slider, a pin for preventing a rotation of the second slider sleeve about its own axis, and a ball bearing for connecting the second slider with the timing piston while allowing the timing piston to be rotatable with respect to the second slider sleeve. The rotation of the output shaft of the motor causes the pinion to be rotated via the worm, and the rotation of the pinion causes the first slider to be rotated about its own axis, which causes the second slider to be moved axially along the direction of the axis of the camshaft, because the second slider is screw-engaged with the first slider and a rotation of the second shaft is prevented by the pin. The axial movement of the second slider in parallel to the axis of the camshaft is transmitted to the camshaft, and thus a relative angular displacement between the crankshaft and the camshaft is controlled.

The camshaft is provided with cams for obtaining a lifting movement of the respective intake valves and exhaust valves, which causes a rotating torque as a reaction force to be generated in the cam shaft. The direction of the reaction force is such that the rotation of the camshaft is relatively delayed with respect to the crankshaft. Namely, even when the valve timing control device is operated such that the camshaft is rotated in a direction that is advanced with respect to the crankshaft, a reaction force will be generated in the crankshaft in a direction in which the rotation of the camshaft is delayed with respect to the crankshaft. To maintain the camshaft at an angular position that is advanced with respect to the crankshaft, a means of preventing the camshaft from being returned in the direction in which the rotation of the camshaft is delayed with respect to the crankshaft must be provided. The worm gear arranged between the rotating drive motor and the slider in the prior art allows only one directional transmission of the movement from the electric motor to the slider. Namely, any transmission of the movement in the reverse direction, i.e., the direction from the slider to the motor, is prevented, and this allows the obtained relative rotational angle relationship between the crankshaft and the camshaft to be maintained unchanged even if no provision is made therefore.

In the prior art, the slider moves the timing piston in the direction parallel to the axis of the camshaft, to obtain a relative rotating movement of the first and second helical splines in spline engagement with the first and second helical splines. In this construction, the timing piston is connected to the slider via a ball bearing assembly, which allows the timing piston to rotate about the slider while the axial movement of the slider along the axis of the camshaft is transmitted to the timing piston. In the prior art, however, a rigid connection is obtained between the slider and the timing piston. Namely, the ball bearing assembly is provided with an inner race press fitted to the timing piston and an outer race press-fitted to the slider. Such a rigid connection between the slider and the timing piston in the prior art makes it difficult to obtain a smooth movement between the slider and the timing piston, when there is a misalignment of the axis of the slider and the axis of the camshaft in a tolerance range, and as a result, a smooth control of a mutual positioning of the slider and the camshaft cannot be obtained.

Furthermore, the prior art construction is disadvantageous in that a desired amount of lubricating oil cannot be supplied to the worm gear mechanism and the ball nut mechanism, each having parts which are mutually engaging, so that a smooth movement between these parts is sometimes lost.

Still further, the prior art construction is disadvantageous in that the lubrication oil for the worm gear mechanism and the ball nut mechanism is often accumulated therein when the engine is stopped. The viscosity of the oil is increased during low temperature condition, and the high viscosity of the oil thus accumulated during a stoppage of the engine at a low temperature can make it difficult to ensure that the worm gear and/or the ball nut mechanism are moved smoothly, and thus a desired control of the mutual position of the camshaft with respect to the crankshaft cannot be obtained, and accordingly, the cold engine cannot be easily started.

SUMMARY OF THE INVENTION

An object of the present invention is to provide a valve timing control apparatus capable of overcoming the above mentioned drawbacks.

Another object of the present invention is to provide a valve timing control apparatus capable of obtaining a smooth control of the valve timing, regardless of any misalignment of the axis of the member connected to the camshaft and the member connected to a feed mechanism.

Still another object of the present invention is to provide a valve timing control apparatus capable of obtaining a desired lubrication of parts wherein a relative sliding movement occurs.

A further object of the present invention is to provide a valve timing control apparatus capable of obtaining a desired operation when a cold engine is to be started.

According to one aspect of the present invention, an apparatus is provided for controlling a valve timing in an internal combustion engine, having an engine block, a crankshaft mounted to the engine block, a camshaft mounted to the engine block, and a power receiving member rotatably mounted on the camshaft for receiving a rotational movement from the crankshaft, said apparatus comprising:

a housing connected to the engine block;

a first sleeve member fixedly connected to one end of the camshaft, the first sleeve member defining, at a cylindrical surface thereof, a helical spline;

a second sleeve member fixedly connected to the power receiving member;

a timing piston movable along the axis of the camshaft, the timing piston having a first helical spline portion engaging with the first sleeve member and a second spline portion engaging with the second sleeve in such a manner that the axial movement of the timing piston causes a mutual angular position between the camshaft and the power receiving member to be obtained;

rotary drive means for generating a rotating movement;

a feed mechanism having a rotating part rotatable with respect to the housing and connected to said rotary drive means and a linearly moving part moved with respect to the housing along the axis of the camshaft upon the rotation of the rotating part, and;

means for connecting the linearly moving part with the timing piston so that the axial movement from the feed mechanism is transmitted to the rotating timing piston, while a limited radial, relative movement is allowed between the linearly moving part and the timing piston.

This invention allows the feed mechanism and the timing piston to be connected and be radially movable within a limited range, so that a smooth transmission of the axial movement from the feed mechanism to the timing piston is obtained regardless of an inevitable misalignment of the axis of the feed mechanism and the axis of the timing piston.

According to another aspect of the invention, an apparatus is provided for controlling a valve timing in an internal combustion engine, having an engine block, a crankshaft mounted to the engine block, a camshaft mounted to the engine block, and a power receiving member rotatably mounted on the camshaft for receiving a rotational movement from the crankshaft, said engine including an oil supply passageway in the engine block for a lubrication of various parts therein, said apparatus comprising:

a housing connected to the engine block;

a first sleeve member fixedly connected to one end of the camshaft, the first sleeve member defining, at a cylindrical surface thereof, a helical spline;

a second sleeve member fixedly connected to the power receiving member;

a timing piston movable along the axis of the camshaft, the timing piston having a first helical spline portion engaging with the first sleeve member and a second spline portion engaging with the second sleeve in such a manner that the axial movement of the timing piston causes a mutual angular position between the camshaft and the power receiving member to be obtained;

rotary drive means for generating a rotating movement;

a feed mechanism having a rotating part rotatable with respect to the housing and connected to said rotary drive means and a linearly moving part moved with respect to the housing along the axis of the camshaft upon the rotation of the rotating part;

means for connecting the linearly moving part with the timing piston for transmission of the axial movement from the feed mechanism to the timing piston;

said oil supply passageway being opened to a space formed between the housing and the engine block for lubricating the parts therein, including the feed mechanism, and;

means for defining an oil returning passageway constructed such that the oil supplied to the feed mechanism is exhausted and does not remain therein when the engine is stopped.

This invention allows the feed mechanism to be properly lubricated, and the oil to be smoothly evacuated via the return passageway when the engine is stopped, which prevents the oil from being accumulated in the feed mechanism, and thus a smooth operation of the feed mechanism is obtained even when the viscosity of the oil is high because the engine is cold.

DESCRIPTION OF THE PREFERRED EMBODIMENT

Figure 1:
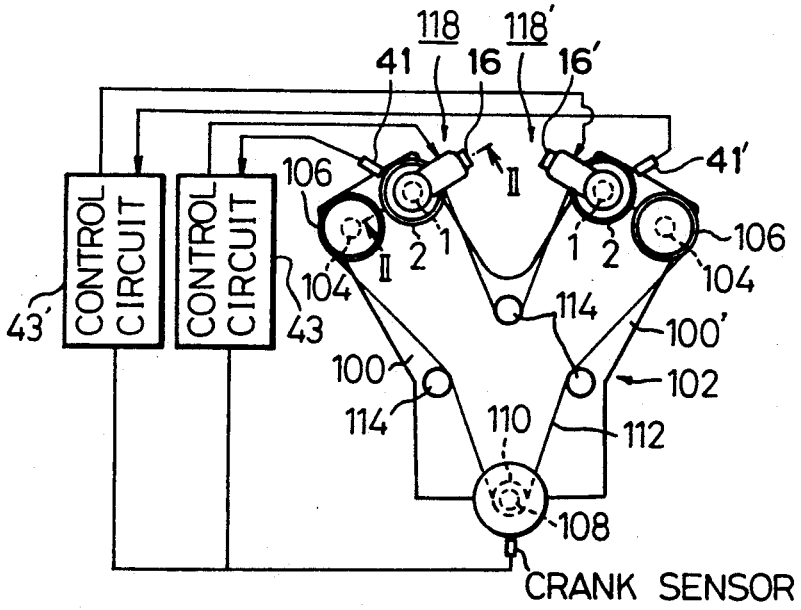
FIG. 1 shows a V-type internal combustion engine provided with a valve timing control apparatus according to the present invention, for each bank of the engine.

FIG. 1 shows an internal combustion engine of V-type wherein an engine block 102 has first and second banks 100 and 100', each provided therein with a plurality of cylinders. Each of the banks 100 and 100' has a camshaft 1 for intake valves (not shown) and a camshaft 104 for exhaust valves (not shown). Each of the camshafts 1 for the intake valves of the respective banks has a timing pulley 2 mounted thereon, and each of the camshafts 104 for the exhaust valves has a timing pulley 106 mounted thereon. The engine block 102 is provided with a crankshaft 108 on which a timing pulley 110 is mounted, and looped around the timing pulleys 2, 104 and 110 is a timing belt 112 for transmitting the rotational movement of the crankshaft 108 to the camshafts 1 and 104. Reference numerals 114 are idler pulleys. Reference numerals 118 and 118' illustrate valve timing control devices, respectively, according to the present invention, for controlling the intake valve timing for the intake valves of the banks 100 and 102, respectively. As will be easily seen, the valve timing control devices 118 and 118' are provided with electric rotating motors 16 and 16', respectively, as actuators for obtaining a desired valve timing, as will be fully explained later.

Figure 2:
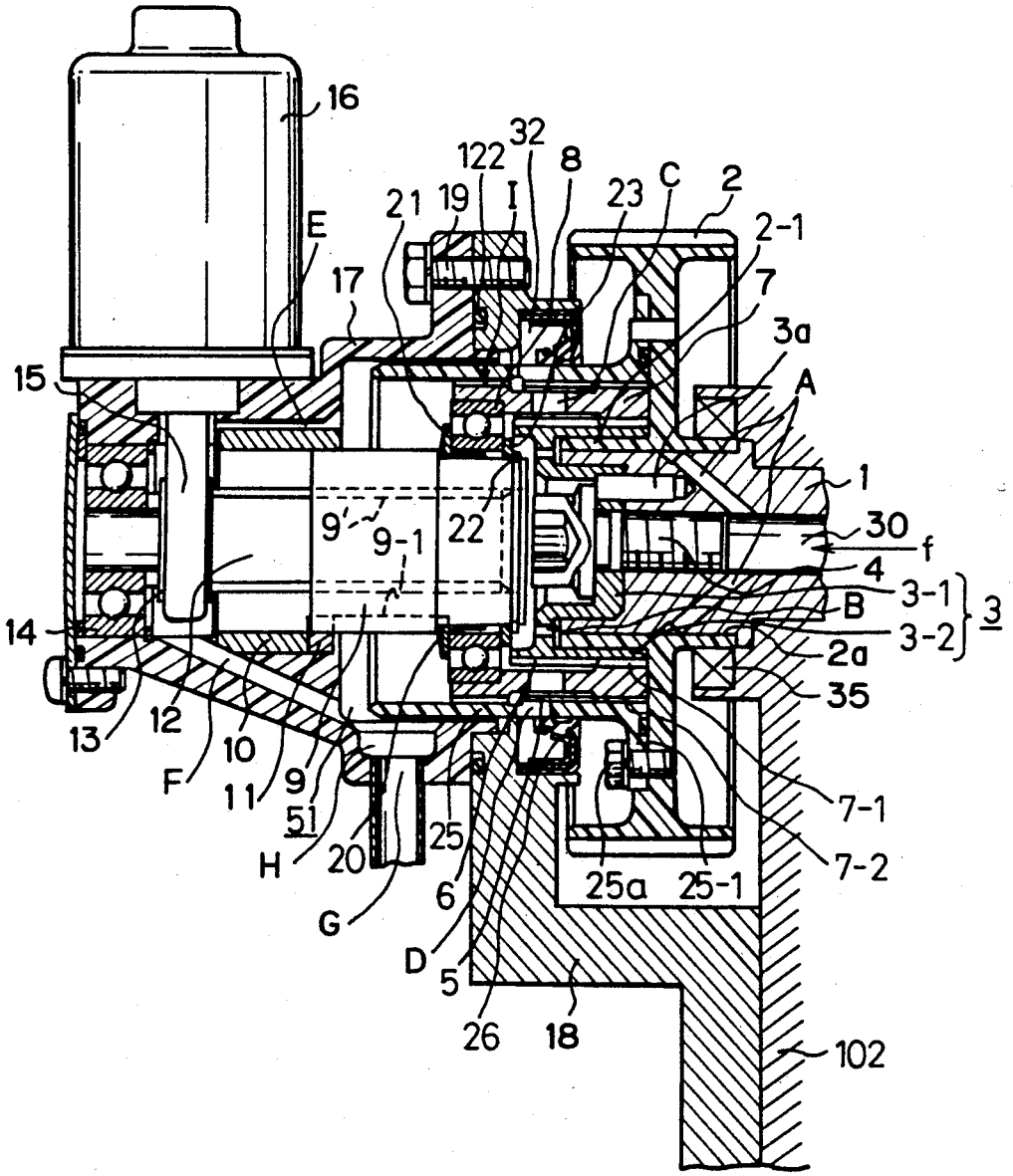
FIG. 2 is a longitudinal cross sectional view of the valve timing control apparatus according to the present invention, taken along lines II—II in FIG. 1.

FIG. 2 is a axial cross-sectional view taken along a line II—II in FIG. 1. As shown in FIG. 2, a housing 17 is connected, via an O ring 122, to a stay 18, which is an integral part of an engine block 102, whereby a space 51 is created between the housing 17 and the stay 18 for housing therein parts of the variable valve timing apparatus to be lubricated, as will be described later. The center boss portion 2-1 of the timing pulley 2 has a bore 2*a* that receives one end of the camshaft 1, and a bolt 4 is screw-engaged to the camshaft 1 via a camshaft sleeve 3 at a closed end 3-1 thereof. The camshaft sleeve 3 has a sleeve portions 3-2 which is slidably and rotatably inserted to the boss portion 2-1 of the timing pulley 2, which is itself slidably and rotatably inserted to the camshaft 1. A pin 3*a* is inserted to aligned bores formed axially along the camshaft 1 and the sleeve 3, by which the rotational movement of the camshaft 1 and the sleeve 3 are integrated about the axis of the camshaft 1, and the timing pulley 2 is slidable and rotatable with respect to both the camshaft 1 and the camshaft sleeve 3.

A pulley sleeve 25 is arranged coaxially with respect to the camshaft 1, via a seal unit 26, and has an outer flange 25-1 fixedly connected to the hub portion of the timing pulley 2 by bolts 25*a*. The camshaft sleeve 3 and the pulley sleeve 25 form, respectively, opposite outer and inner cylindrical surfaces on which helical splines 6 and 5, respectively, are formed, and which extend along opposite directions at the same angle with respect to the axis of the camshaft 1. A timing piston 7 is arranged between the camshaft sleeve 3 and the pulley sleeve 25, and has a sleeve shape defining inner and outer cylindrical surfaces on which helical splines 7-1 and 7-2 are respectively formed. The inner helical spline 7-1 of the timing piston 7 is engaged with the outer helical spline 6 of the camshaft sleeve 2, and the outer helical spline 7-2 of the timing piston 7 is engaged with the inner helical spline 5 of the pulley sleeve 25. Due to the spline engagement of the timing piston 7 with respect to the camshaft sleeve 3 integrally rotated with the camshaft 1 and the pulley sleeve 25 integrally rotated with the timing pulley 2, the rotational movement of the timing pulley 2 transmitted from the crankshaft 108 via the timing pulley 112 is transmitted to the camshaft 1. Further, upon an axial movement of the timing piston 7, positions of the engagement of the inner spline 7-1 of the timing pulley 7 with the outer spline 6 of the camshaft sleeve 3, as well as positions of the engagement of the outer spline 7-2 of the timing piston 7 with the inner spline 5 of the pulley sleeve 25, are correspondingly changed. The movement of the positions of the engagement between the helical splines 7-1 and 6, and between 7-2 and 5 cause the camshaft sleeve 3 and the pulley sleeve 25 to be rotated with each other in opposite directions, because the engaged splines 7-1 and 6 and the engaged splines 7-2 and 5 are oppositely inclined with respect to the axis of the camshaft 1. As a result, a mutual angular displacement of the timing pulley 2 with respect to the camshaft 1 can be controlled in accordance with the axial position of the timing piston 7 when the engine is operating.

A ball-screw mechanism is provided for obtaining an axial movement of the timing piston 7, and is constructed by a ball screw 12 and a sleeve-shaped nut 9 which are in a screw engagement via balls (not shown) housed in a closed passageway (not shown) in the nut 9, as well known to those skilled in this art. The ball screw 12 has a first end connected rotatably to the housing 17 via a ball bearing unit 14, and a second end located adjacent to the camshaft sleeve 3 and having a screw thread. The nut 9 has a screw thread 9' which engages with the ball screw 12, and has a first end axially slidably supported by a sleeve-shaped oil-less metal bearing 10 connected to the housing 17, and a second end connected to the timing piston 7 via a means for connecting the nut 9 to the timing piston 7 while allowing a rotation of the timing piston 7 with respect to the nut 9 and allowing a slight mutual movement between the nut 9 and the timing piston 7 without allowing a rattle, as will be fully described later. The nut 9 has, axially, on the outer wall thereof, a key-way 9-1 with which a key 11 is engaged at an end thereof. The key 11 is fixedly connected to the housing and extended radially inward therefrom. The key-way key 9-1 and the key 11 can prevent a rotation of the nut about its own axis so that the rotational movement of the ball shaft 12 is transformed into the axial slidable movement of the nut 9. The oil-less metal bearing member 10 is axially slidable with respect to the nut 9, to thereby obtain a smooth and frictionless linear movement of the nut 9.

A gear wheel 13, with which a worm shaft 15 is engaged, is fixed on the ball screw shaft 12. The worm shaft 15 is extended from the electric motor 16 as an output shaft, and a rotational movement of the worm shaft 15 causes the ball screw shaft 12 to be rotated via the gear 13. The rotational movement of the screw shaft 12 causes the nut 9 to axially slide on the oilless metal bearing, because the key connection between the keyway on nut 9 and the key 11 of the housing prevents a rotation of the nut 9 about its own axis. The axial movement of the nut 9 is transmitted, via the ball bearing assembly 8, to the timing piston 7, to obtain a mutual rotational movement of the timing pulley 2 connected to the crankshaft 108 and the camshaft 1. A control of a rotation number of the electric motor obtains a desired degree of a mutual rotation angle between the timing pulley 2 and the camshaft 1, to thus obtain a desired valve timing.

It should be noted that the motor 16 is connected to the housing 17, which is separate from the engine body 102, and fixedly connected to a stay 18 by bolts 19. The stay 18 is connected to the engine block 102 by a suitable fixing means.

Figure 3:
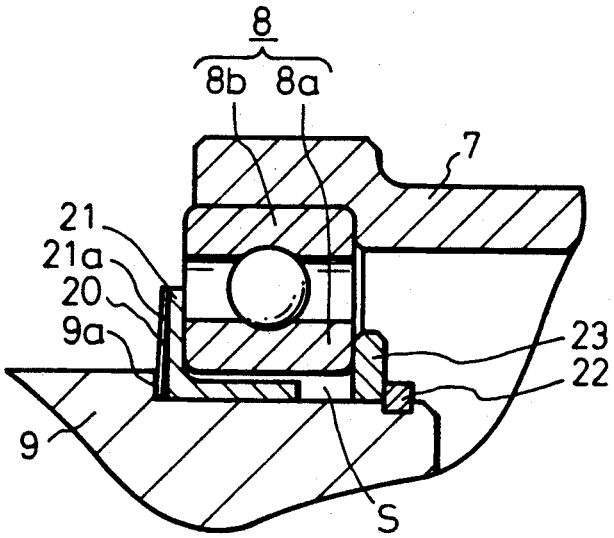
FIG. 3 is an enlarged partial view of a portion of FIG. 2, and illustrates a construction of a connecting means for connecting the screw shaft to the timer piston.

FIG. 3 illustrates, in detail, a means for a transmission of the axial linear movement of the nut 9 to the timing piston 7 during the rotation of the piston 7, and a slight radial movement between the nut and the timing piston 7 is allowed without generating any rattle therebetween. Namely, the nut 9 has a reduced diameter end portion forming a shoulder 9*a*. A Belleville spring (disk spring) 20 and a spacer member 21 having an L-cross-section are closely fitted to the reduced diameter portion of the nut 9, so that the spring 20 abuts against the shoulder portion 9*a*. The annular member 21 forms a flange portion 21*a* extended radially to be located between the spring 20 and an inner racing of the bearing assembly 8. An annular washer 23 is also closely fitted to the reduced diameter end of the nut 9 so that the washer 23 abuts against the end of the inner race 8*a* of the bearing assembly remote from the spacer member 21. Furthermore, the nut 9 has an annular groove in which a snap ring (as a stopper) 22 is fitted so that it abuts against the washer 23 at an axial end thereof remote from the inner race of the bearing unit 8. As a result, the spring 20 generates a spring force causing the inner race 8*a* of the bearing unit 8 to be held between the flange portion 21*a* of the spacer 21 and the washer 23. Furthermore, the inner race 8*a* of the bearing unit 8 has an inner diameter larger than the outer diameter of the end of the nut 9, and thus an annular clearance S is formed between the bearing unit 8 and the nut 9. Contrary to this, the outer race 8*b* of the bearing unit 8 is press-fitted to an annular recess 7-1 of the timing piston 7. As a result, the bearing unit 8 can rotatably support the timing piston 7 with respect to the nut 9, and the axial movement from the nut 9 is transmitted to the piston 7 without any play because the bearing unit 8 is resiliently fixed to the nut 9 by the force of the spring 20. In addition, the clearance S between the bearing unit 8 and the nut 9 allows the timing piston 7 and the nut 9 to be radially moved by a limited degree where there is some misalignment of the axis of the timing piston 7 and the axis of the nut 9, which is usually inevitable even within a range of tolerance. As a result, a smooth transmission of movement can be obtained between the nut 9 and timing piston 7.

In the first embodiment as described above, an oil supply passageway is provided for a lubrication of the engaged portion created between the worm 15 and worm wheel 13, and portions between which any sliding movement occurs, and as a result, a low friction movement along these portions is realized, resulting in an increased service life of the device. As shown in FIG. 2, the camshaft 1 has a central bore 30 for receiving a flow of the lubricant from a lubrication oil pump (not shown), and a pair of lubricant oil holes A have first ends thereof connected to the central bore 30 for receiving the flow of oil therefrom, and second ends thereof opened to an annular groove formed at the outer periphery of the camshaft 1, and as a result, the lubrication oil is supplied to sliding portions between the camshaft 1, the timing pulley 2, and the camshaft sleeve 3. Furthermore, an end of the camshaft sleeve 3 has axial openings B for an introduction of the oil for lubricating the bearing unit 8, as well as the helical splines 7-1 and 6 between the camshaft sleeve 3 and the timing piston 7. The timing piston 7 has angularly spaced holes C formed therethrough for introducing oil for lubricating the helical splines 7-2 and 5 between the timing piston 7 and the pulley sleeve 25. Furthermore, the pulley sleeve has angularly spaced lubrication holes D for receiving the flow of the oil directed outward. The seal unit 26 prevents the oil from leaking into the timing pulley 2. The timing piston 7 has, at an end thereof remote from the timing pulley 2, an angularly spaced axially extending groove I for receiving the flow of oil from the openings C, and for directing the oil to the nut 9 and the ball screw 12, which are engaged with each other, for a lubrication therefore. The housing 17 has an axially extending groove E on the inner cylindrical surface thereof facing the metal bearing 10 for directing the oil flow from the groove I into the portion at which the worm 15 is engaged with the wheel 13, for a lubrication thereof. The housing 17 has, at a location below the ball screw, a downwardly-inclined oil passageway F having an upper end opened toward an inside of the housing 17 at a location facing the worm member 15 and a lower end opened to an oil reservoir recess H formed inside the housing 17 at a location adjacent to the pulley sleeve 25 and at the bottom thereof. An oil return pipe G has an upper end connected to the oil reservoir recess and a lower end (not shown) connected to an oil pan (not shown), for removing the oil after a lubrication of the various parts in the valve timing control device as shown in FIG. 1.

It should be noted that, in addition to the oil seal 26 between the pulley sleeve 25 and an engine body portion 18 on one side of the pulley 2, a second oil seal 35 is arranged between the portion 2-1 of the timing pulley 2 and the portion of the engine body. As a result, the oil for lubricating the camshaft 1 and the valve timing control devise is prevented from being leaked into the timing pulley 2 with which the timing belt 112 made of a rubber material is engaged, which would otherwise cause the timing belt 112 to be damaged.

An oil pump (not shown) is provided as in a conventional technique, so that a forced flow of the lubrication oil from the not shown oil pump is created, which flow is introduced into the passageway 30 as shown by an arrow f. The oil is then directed into the passageway B for lubricating the sliding parts between the portion 2-1 of the timing pulley 2 and the camshaft 1. Then part of the oil is passed through the openings B and is introduced into the ball bearing 8 and the ball screw 12, to lubricate same. The remaining part of the oil is directed to the engaged helical spline 6 of the camshaft sleeve 3 and the helical spline 7-1 of the timing piston 7, and a part thereof is directed to the engaged helical spline 5 of the pulley sleeve 25 and the helical spline 7-2 of the timing piston 7, to lubricate same. Most of the remaining lubricating oil is passed through the radial oil holes C under the effect of centrifugal force, and then flows along the inner periphery of the pulley sleeve 25 toward the free end thereof via the axially extending grooves I thereon. The flow of the oil along the grooves I is subjected to the centrifugal force, at the free end thereof and thus is directed to the inner surface of the housing 17, and mainly directed to a space 51 for lubricating the screw shaft 12 and the nut 9, which are engaged with each other, and part thereof is introduced into the axial grooves E so that the oil is supplied to the engaged worm gear 15 and the worm wheel 13, for lubricating same. The oil after lubricating the engaged portions is received by the return passageway F.

The oil after lubricating the various parts of the device as described above flows downward along the return passageway F and the inner wall of the housing 17, and is introduced into the reservoir portion H and returned, via the return pipe G, to the oil pan (not shown).

It should be noted that a plurality of the lubrication passageways C and E are arranged to be spaced circumferentially, so that a smooth axial movement of the timing piston 7 can be obtained without being blocked by the lubricating oil, which will be otherwise locally filled therein. Furthermore, the oil introduced into an annular portion adjacent to the seal member 26 via the radial passageways D can be exhausted into the reservoir portion H by way of a small gap created between the pulley sleeve 25 and the housing 17.

When the internal combustion engine is stopped, the lubrication oil in the ignition timing control apparatus is returned back to the oil pan via the oil passageways as above mentioned, and thus the oil in the apparatus does not remain therein. Otherwise, the oil in the apparatus will increase a resistance force to the starting of the engine when it is cold, because the viscosity of the oil is high.

According to the first embodiment, the engaged portions of the worm gear 15 and the worm wheel 13, and of the helical splines 6 and 7-1, and 5 and 7-2 are always supplied by a flow of lubrication oil, which effectively prevents a rapid wear of these parts even when a high relative speed is generated between parts engaged with each other, and thus an increased durability and service life thereof can be realized.

Furthermore, various loads are applied to parts in the apparatus, such as the helical splines 6 and 7-1, and 5 and 7-2, the ball bearing 8, the ball screw 12 and the nut 9, due to the engine vibration and a variation of the rotating torque of the camshaft 1, which causes a rapid wear of these parts and a sticking thereof. The lubrication means in the first embodiment prevents the occurrence of these problems.

Figure 4:
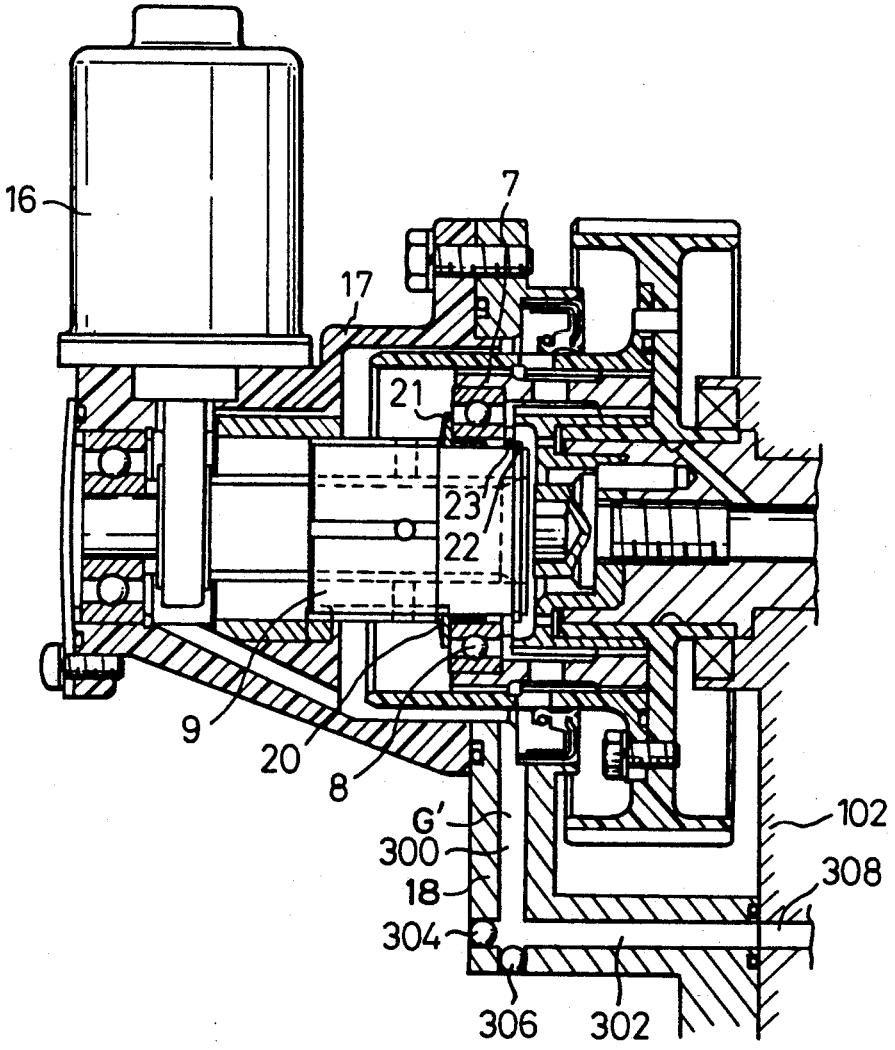
FIG. 4 is similar to FIG. 2, but directed to a second embodiment.

FIG. 4 shows a second embodiment of the present invention wherein, in place of the separate pipe G in the first embodiment (FIG. 2), the stay 18 has bores 300 and 302 formed therein, which bores are outwardly closed by plugs 304 and 306 for constructing a return passageway G' in communication with a passageway 308 in the engine block 102, which passageway 308 is connected to the oil pan (not shown). This embodiment is advantageous in that the number of parts is reduced, and thus the construction can be simplified. Similar to the first embodiment, the second embodiment is also provided with connecting means, constructed by a ball bearing 8 (having an inner race connected to the nut 9 with a clearance), a Belleville spring 20, a spacer 21, a washer 23 and a snap ring 22, for connecting the nut 9 and the timing piston 7 for a transmission of an axial movement during the rotational movement of the timing piston 7 with respect to the nut 9, and allowing a slight radial movement between the timing piston 7 and the nut 9.

Figure 5:
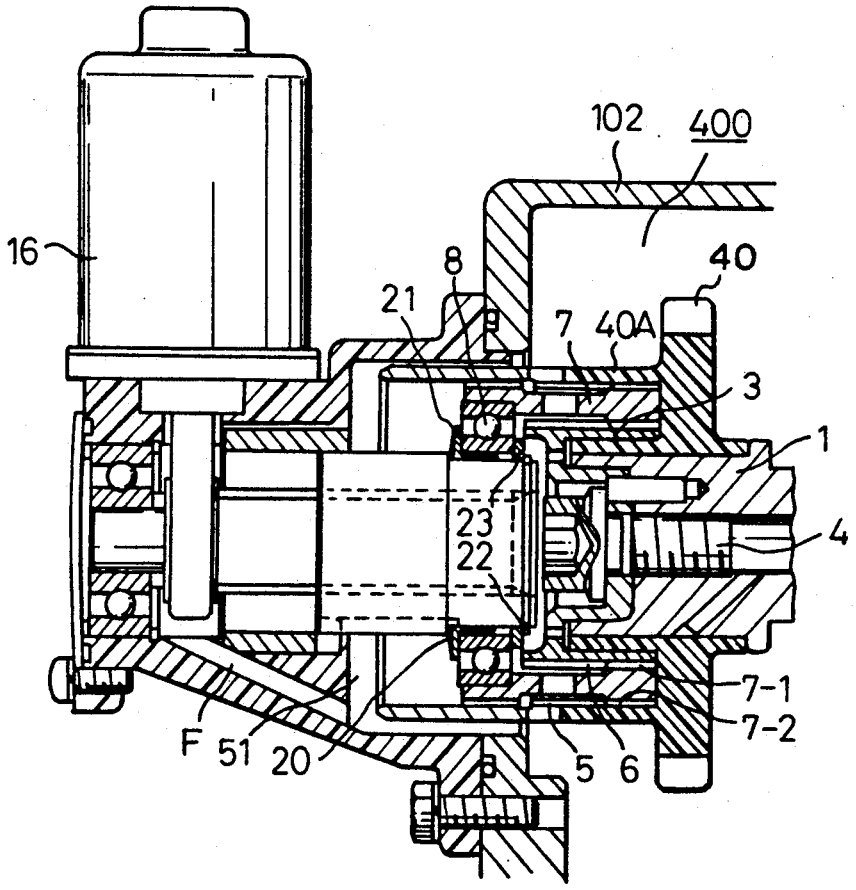
FIG. 5 shows a third embodiment, where a gear is used in place of timing pulley for obtaining a power transmission to the camshaft.

FIG. 5 shows a third embodiment wherein, in place of the timing pulley 2, a timing gear 40 is rotatably mounted on a camshaft 1. The timing gear 40 is in mesh with a gear (not shown) for transmitting the rotational movement from the camshaft (not shown in FIG. 5). A timing piston 7 is arranged between a camshaft sleeve 3 fixed to the camshaft 1 by a bolt 4, and a sleeve 40A, which is integral with the hub portion of the timing gear 40. The timing piston 7 has, at outer and inner cylindrical surfaces thereof, helical splines 7-1 and 7-2 in engagement with corresponding helical splines 6 and 5 on the camshaft sleeve 3 and the gear sleeve 40A, and as a result, a mutual rotational movement is obtained between the camshaft 1 and the gear 40 due to the axial movement of the timing piston 7, to thereby control the valve timing.

Similar to the first and second embodiments, the third embodiment is also provided with a connecting means constructed by a ball bearing 8, a Belleville spring 20, a spacer 21, a washer 23 and a snap ring 22, for connecting the nut 9 and the timing piston 7 for a transmission of the axial movement, and allowing a rotating movement of the timing piston 7 with respect to the nut 9, and further allowing a slight radial movement between the timing piston 7 and the nut 9.

Unlike the first and second embodiments, wherein the timing pulley 2 connected to a timing belt is used, and thus the sealing members 26 and 25 are essential for preventing damage to the belt, the gear engagement in the third embodiment uses the oil to lubricate the gear 40, as the latter is housed in a chamber 400 in the engine block 102 to which the lubrication oil from the oil pump (not shown) is circulated. Therefore, in the third embodiment, the separate passageway G in FIG. 2 or G' in FIG. 4 can be eliminated, and the oil after having lubricated various parts of the apparatus is directly introduced from the space 51 and through the passageway F into the chamber 400.

The employment of the lubrication oil from the oil pan in the above embodiments allows the worm gear mechanism to smoothly rotate the ball screw to thereby obtain a mutual rotational movement of the camshaft and the timing pulley or timing gear. The employment of the worm gear mechanism provides a very high reduction ratio, and thus only a rotational motor having a very low rotating torque is needed for obtaining a force necessary to obtain a desired axial movement of the timing piston, for obtaining a desired mutual position of the camshaft to the timing pulley 2 or timing gear 40. Such a low torque motor 16 reduces the size of the apparatus, and thus is advantageous when mounting same in a limited space in an engine room. The employment of the worm gear mechanism prevents the transmission of a reaction torque from the ball screw 12 to the motor 16, and accordingly, the a rotation of the ball screw 12 by the reaction force is prevented even when the electric motor 16 is deenergized after a desired mutual position between the camshaft 1 and the timing pulley 2 is obtained. Therefore, a consumption of electric energy is lowered, and this is advantageous for the service life of the batteries.

Furthermore, the low output torque of the electric motor 16 with a high rotational speed increases a response time, because a quick initial increase in the speed can be obtained.

Figure 6:
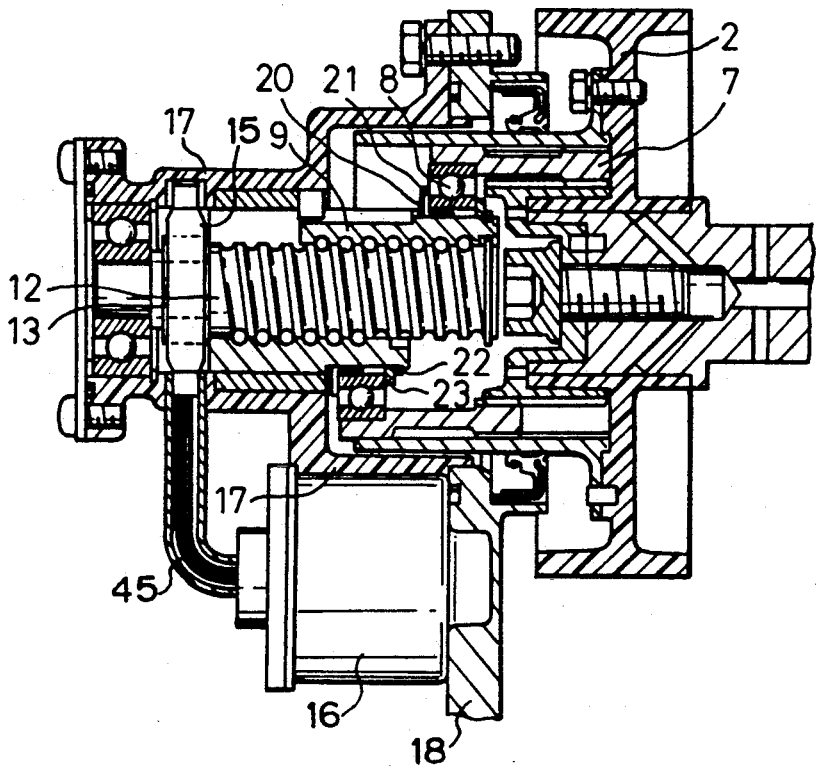
FIG. 6 shows another embodiment, where a flexible wire is employed for connecting the motor to the ball nut mechanism.

FIG. 6 shows a fourth embodiment of the present invention. This embodiment is based on the use of the low torque motor due to the employment of the worm mechanism. Namely, a flexible wire 45 is provided for connecting the electric motor 16 with the worm wheel 15 engaged with the worm wheel 13 for transmitting the rotational movement from the motor 16 to the ball screw 12. This embodiment increases the freedom of the arrangement of the motor 16. Namely, the motor 16 in this embodiment is arranged below the housing 17, and is directly connected to the stay 18, and as a result, a weight overhanging the device can be reduced, resulting in a reduction in a vibration thereof.

It should be noted that the device in FIG. 6 is also provided with an oil return passageway for returning the oil to the engine after lubricating various portions of the valve timing control device, as in the previous embodiments, although this is not shown, for the sake of simplicity. Furthermore, the upper half portion of the nut 9 is shown at the most forwardly moved position thereof where the timing piston 7 is moved so that the piston 7 abuts against the hub portion of the timing pulley 2, and the lower half position thereof is, shown when it is at the most rearwardly moved position where the timing piston 7 is located adjacent to the housing 17.

Similar to the previous embodiments, the embodiment in FIG. 6 is also provided with a connection means constructed by a ball bearing 8, spring 20, spacer 21, washer 23, and snap ring 22.

As explained with reference to FIG. 1, for a V-type internal combustion engine, separate motors 16 and 16', which are controlled by the control circuits 43 and 43', respectively, are provided, and these electric motors 16 and 16' are connected to respective valve timing control devices for controlling relative angular positions of the camshafts 1 and the timing pulleys 2 of the banks 118 and 118', respectively.

Figure 7:
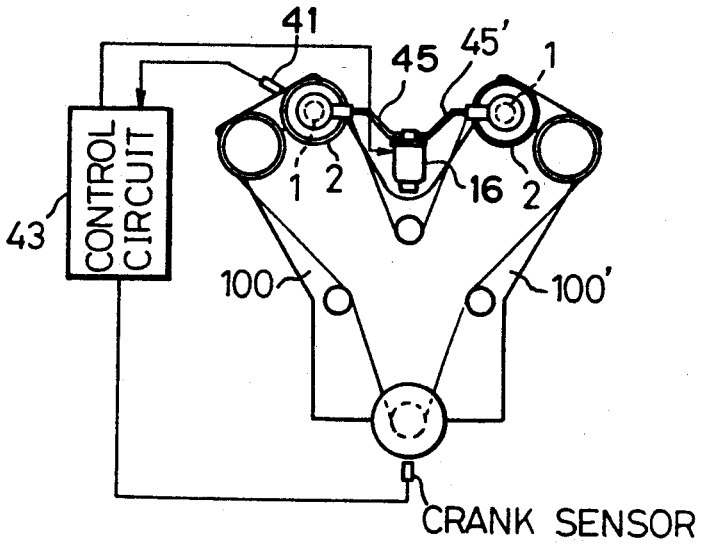
FIG. 7 is similar to FIG. 1 but is directed to another arrangement wherein a common, single motor is used in the valve timing control apparatus for both banks of the V engine.

In another modification, as shown in FIG. 7, only a single electric motor 16 is provided, which is connected, via respective flexible wires 45 and 45', to the respective valve timing control devices for controlling relative angular positions of the camshafts 1 and the timing pulleys 2 of the banks 100 and 100', respectively. In this case, the single electric motor 16 is connected to a single control circuit 43 for controlling the operation of the motor 16 to thus adjust the valve timing.

Figure 8:
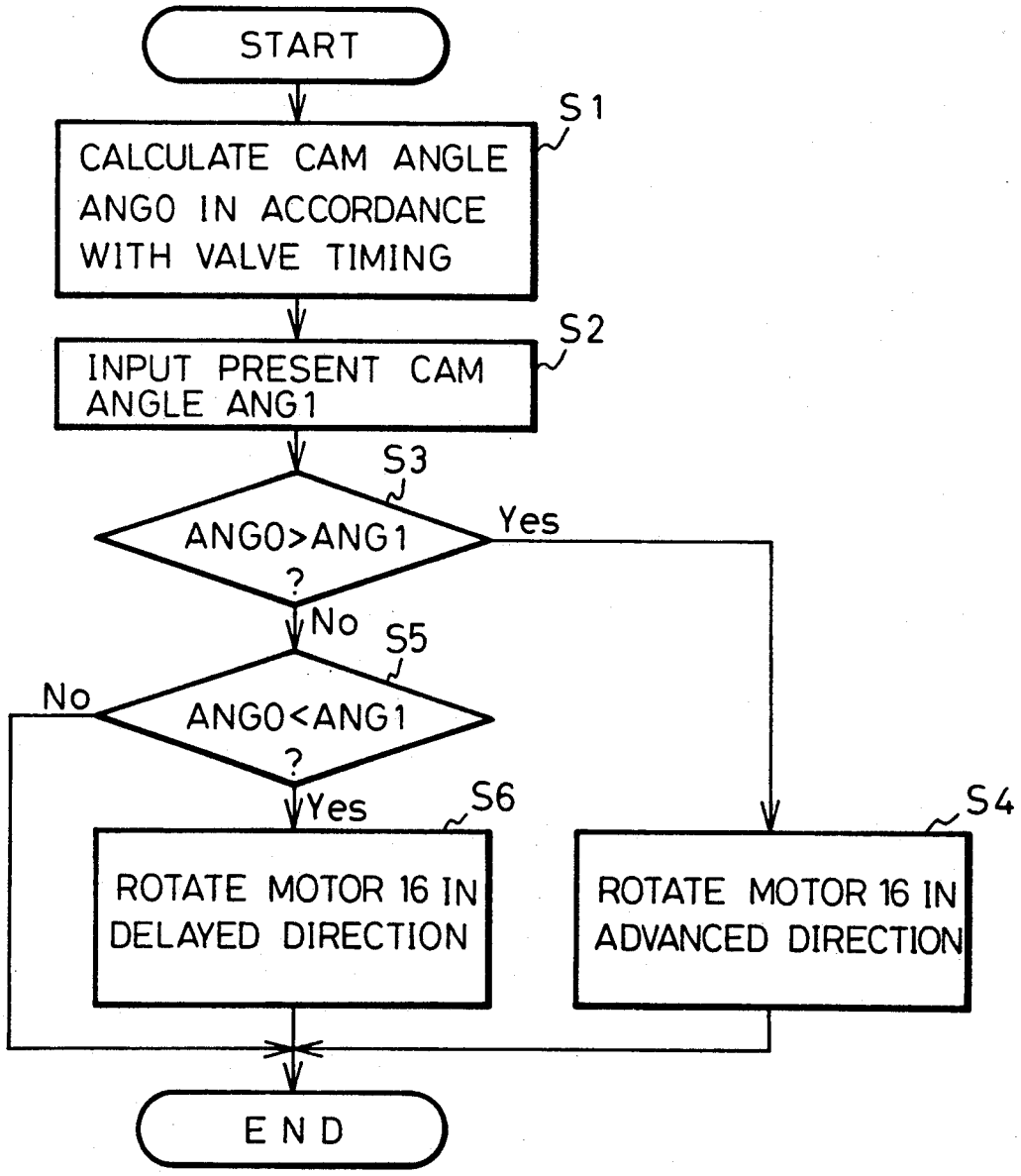
FIG. 8 schematically illustrates the operation of the valve timing control in a control circuit in FIG. 7 or 8.

FIG. 8 is a flowchart illustrating the operation of the control circuit 43 or 43' when controlling the valve timing. At step S1, a target value of a valve timing ANG0, which is a relative angular position of the camshaft 1 with respect to the crankshaft 108, is calculated. The target valve timing is determined in accordance with engine operating conditions, such as an engine rotational speed and intake pressure. In a well known manner, a map of the values of the valve timings is provided for various combinations of values of the engine speed and intake pressure, and a map interpolation calculation is carried out to obtain a target value of ANG0 corresponding to a combination of a detected engine speed and intake air pressure. In this case, it is determined that the larger the value of the relative angle ANG0, the more advanced the valve timing.

At step S2, an actual relative angle ANG1 of the camshaft 1 with respect to the crankshaft 108, which is detected by the cam angle sensor 41 or 41', is obtained, and at step S3, it is determined if the value of the target value of the cam angle ANG0 is larger than the actual value of the cam angle ANG1, i.e., the valve timing is controlled in a direction for advancing same. When it is determined that ANG0>ANG1, the routine goes to step S4 and the motor 16 or 16' is controlled so that a rotation thereof is obtained in the direction for advancing the valve timing. When it is not determined that ANG0<ANG1 at step S3, the routine goes to step S5 and it is determined if the value of the target value of the cam angle ANG0 is smaller than the actual value of the cam angle ANG1, i.e., the valve timing is controlled in a direction for delaying same. When it is determined that ANG0<ANG1, the routine goes to step S6 and the motor 16 or 16' is controlled so that a rotation thereof is obtained in the direction for delaying the valve timing. When it is not determined that ANG0>ANG1 at step S6, i.e, ANG0=ANG1, steps S4 and S6 are bypassed because it is considered that the detected valve timing ANG1 is equal to the target valve timing ANG0.

Figure 9:
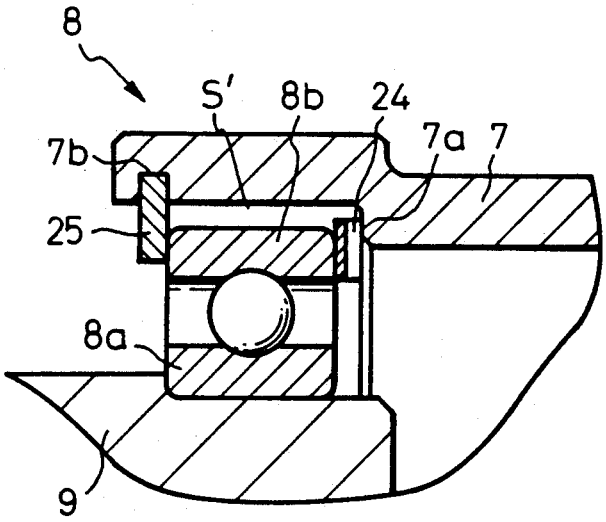
FIG. 9 is similar to FIG. 3, but shows another embodiment of the connection means.

FIG. 9 shows another embodiment of the connection means for connecting the axial movement of the timing piston 7 rotatably to the nut 9, while permitting the nut 9 to be slightly radially movable with respect to the timing piston 7. The radially adjustable connection of the inner race 8*a* of the ball bearing 8 to the ball screw 9 in the first embodiment in FIG. 3 is changed to a radially adjustable connection of the outer race 8*b* to the timing piston 7 in FIG. 9. Namely, the inner race 8*a* of the bearing unit 8 is press-fitted to the nut 9, and the outer race 8*b* of the bearing unit 8 is inserted to the timing piston 7 so that an annular space S' is created between the facing cylindrical surfaces of the bearing 8 and the timing piston 7. The outer race is contact at one end thereof with a snap ring 25, as a stopper fitted to an annular groove 7*b* on the inner cylindrical surface of the timing piston 7, and in contact at the other end thereof with a waved washer 24 having an annular shape and inserted to the screw shaft 9 at one side thereof. The wave-shaped washer 24 is in contact, at the other side thereof, with an annular shoulder 7*a* formed on the inner cylindrical surface of the timing piston 7. The wave washer 24 generates an axial elastic force urging the outer race 8*b* into firm contact with the stopper 25, to thereby axially fix the bearing unit 8 on the screw shaft 9. This construction shown in FIG. 9 allows the axial movement of the nut 9 to be transmitted to the timing piston 7, while allowing the timing piston 7 to be rotatable with respect to the screw shaft 9. Furthermore, the space S' allows a relatively limited radial movement between the bearing unit 8 and the timing piston 7, so that a smooth transmission of power is always obtained from the screw 9 to the timing piston 7, regardless of any inevitable small amount of misalignment of the axis of the screw shaft 9 and the axis of the timing piston 7 within a tolerance.

Figure 10:
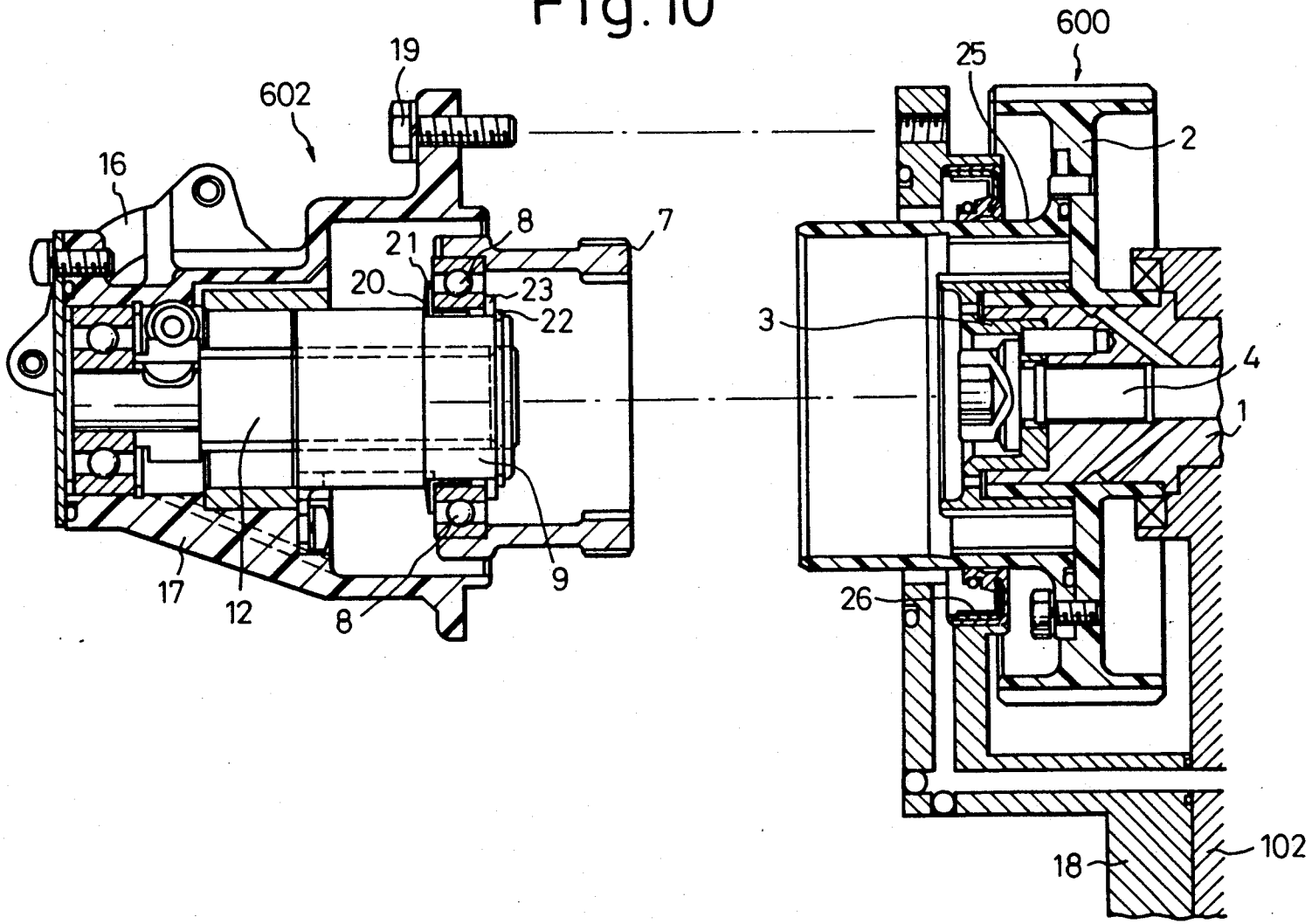
FIG. 10 shows another embodiment and illustrates how the valve timing control apparatus is assembled.

FIG. 10 illustrates a construction of another embodiment, and further, illustrates how the apparatus is assembled. The construction of this embodiment is similar to that of FIG. 2, but is different therefrom in that the angular position of the motor 16 with respect to the housing 17 is rotated by an angle of 90 degree with regard to the construction of FIG. 2. The apparatus is constructed from two sub-assemblies 600 and 602. The first sub-assembly 600 includes parts held by the stay 18, i.e., a pulley 2 with a pulley sleeve 25 is connected to the camshaft 1 by a bolt 4 via a camshaft sleeve 3, and a seal stay 18 connected to the engine block 102. The second sub-assembly 602 is constructed by parts supported by the housing 17, i.e., a nut 9, a screw shaft 12, a timing piston 7, a bearing unit 8 together with the connection means constructed by the spring 20, the spacer 21, stopper 23 and a snap ring 23, and the motor 50. The obtained second sub-assembly 602 is connected to the stay 18 in the first sub-assembly by the bolts 19.

It should be noted that a similar sub-assembly structure based on the housing 17, which is conveniently connected to the stay 18, can be also employed in embodiments other than that of FIG. 10, in a similar way.

Although embodiments of the present invention are described with reference to the attached drawing, many modifications and changes can be made by those skilled in this art without departing from the scope and spirit of the present invention.

What is claimed is:

1. An apparatus for controlling a valve timing in an internal combustion engine having an engine block, a crankshaft mounted to the engine block, a camshaft mounted to the engine block, and a power receiving member rotatably mounted on the camshaft for receiving a rotational movement from the crankshaft, said apparatus comprising:

a housing connected to the engine block;

a first sleeve member fixedly connected to one end of the camshaft, the first sleeve member defining, at a cylindrical surface thereof, a helical spline;

a second sleeve member fixedly connected to the power receiving member;

a timing piston movable along the axis of the camshaft, the timing piston having a first helical spline portion engaging with the first sleeve member and a second spline portion engaging with the second sleeve in such a manner that the axial movement of the timing piston causes a mutual angular positioning of the camshaft and the power receiving member to be obtained;

rotary drive means for generating a rotating movement;

a feed mechanism having a rotating part rotatable with respect to the housing and connected to said rotary drive means and a linearly moving part which is moved with respect to the housing along the axis of the camshaft upon the rotation of the rotating part, and;

means for connecting the linearly moving part with the timing piston so that the axial movement from the feed mechanism is transmitted to the timing piston during a rotation thereof, and a limited radial relative movement is allowed between the linearly moving part and the timing piston.

2. An apparatus according to claim 1, wherein said connecting means comprise a bearing unit for rotatably supporting the timing piston with respect to the linearly moving part, and means for attaching the linearly moving part and the timing piston to each other so that the axial movement of the linearly moving part is transmitted to the timing piston, while allowing the axially moving part and the timing piston to be slightly moved radially.

3. An apparatus according to claim 2, wherein said bearing unit is connected radially loosely to one of the timing piston and the axially moving part of the feed mechanism, and wherein said attaching means comprise a stopper member for obtaining a fixed position of the bearing unit on said member on which the bearing unit is loosely fit, and resilient means for urging the bearing unit axially so that it is firmly held axially by the stopper means.

4. An apparatus according to claim 3, wherein said member on which the bearing unit is loosely fit is the linearly moving member of the feed mechanism, and wherein said resilient means comprise a spacer member which is spaced from the stopper member on the linearly moving member, and a spring member urging the spacer member so that the bearing unit is axially and fixedly held between the stopper member and the spacer member.

5. An apparatus according to claim 4, wherein said resilient member is a Belleville spring inserted to the linearly moving member.

6. An apparatus according to claim 3, wherein said member on which the bearing unit is loosely fit is the timing piston, and wherein said resilient means comprise a wave-shaped annular spring arranged on the side of the bearing unit opposite to the stopper member on the timing piston.

7. An apparatus according to claim 1, wherein said rotary drive means comprise a rotating motor, and a gear connection between the motor and the rotating part of the feed mechanism.

8. An apparatus according to claim 7, wherein said gear connection comprises a worm member connected to the motor and a gear wheel in engagement with the worm member and fixedly connected to the rotating part of the feed mechanism.

9. An apparatus according to claim 8, wherein a flexible connection is provided between the motor and the worm member.

10. An apparatus according to claim 9, wherein said motor is connected to the engine block.

11. An apparatus according to claim 8, further comprising bearing members for rotatably supporting the feed mechanism at said housing at locations on respective sides of the worm wheel.

12. An apparatus according to claim 1, wherein the rotatable portion of the feed mechanism is constructed as a screw shaft having a screw thread on an outer surface thereof, and wherein said axially moving part of said feed mechanism is constructed by a nut member having a screw thread which engages the screw thread on the screw shaft and supported on the housing so that the nut is only slidable axially.

13. An apparatus according to claim 1, wherein said internal combustion engine includes a oil supply passageway in the engine block for lubrication of various parts therein, which oil supply passageway is opened to a space formed between the housing and the engine block for lubricating the parts therein including said feed mechanism, and wherein the apparatus further comprises means for defining an oil return passageway constructed such that the oil supplied to the feed mechanism is exhausted and does not remain therein when the engine is topped.

14. An apparatus for controlling a valve timing in an internal combustion engine, having an engine block, a crankshaft mounted to the engine block, a camshaft mounted to the engine block, and a power receiving member rotatably mounted on the camshaft for receiving a rotational movement from the crankshaft, said engine including an oil supply passageway in the engine block for a lubrication of various parts therein, said apparatus comprising:

a housing connected to the engine block;

a first sleeve member fixedly connected to one end of the camshaft, the first sleeve member defining, at a cylindrical surface thereof, a helical spline;

a second sleeve member fixedly connected to the power receiving member;

a timing piston movable along the axis of the camshaft, the timing piston having a first helical spline portion engaging with the first sleeve member and a second spline portion engaging the second sleeve in such a manner that the axial movement of the timing piston causes a mutual angular positioning between the camshaft and the power receiving member to be obtained;

rotary drive means for generating a rotating movement;

a feed mechanism having a rotating part rotatable with respect to the housing and connected to said rotary drive means and a linearly moving part moved with respect to the housing along the axis of the camshaft upon the rotation of the rotating part;

means for connecting the linearly moving part to the timing piston for a transmission of the axial movement of the feed mechanism to the timing piston;

said oil supply passageway being opened to a space formed between the housing and an engine block for lubricating the parts therein, including the feed mechanism, and;

means for defining an oil return passageway constructed such that the oil supplied to the feed mechanism is exhausted and does not remain therein when the engine is stopped.

15. An apparatus according to claim 14, further comprising supporting members for supporting the axially moving part to said housing at axially spaced locations, and wherein said oil return passageway is, at a top end thereof, opened at a location below the supporting members.

16. An apparatus according to claim 14, wherein said oil supply passageway in the engine is passed through the camshaft.

17. An apparatus according to claim 14, wherein said connecting means connect the linearly moving part to the timing piston so that the axial movement of the feed means is transmitted to the timing piston during a rotation thereof, and a limited radial relative movement is allowed between the linearly moving part and the timing piston.

18. An apparatus according to claim 17, wherein said connecting means comprise a bearing unit for rotatably supporting the timing piston with respect to the linearly moving part, and means for attaching the linearly moving part and the timing piston to each other so that the axial movement of the linearly moving part is transmitted to the timing piston, while allowing the axially moving part and the timing piston to be slightly moved radially.

19. An apparatus according to claim 18, wherein said bearing unit is radially loosely connected to one of the timing piston and the axially moving part of the feed mechanism, and wherein said attaching means comprise a stopper member for obtaining a fixed position of the bearing unit on said member on which the bearing unit is loosely fit, and resilient means for urging the bearing unit axially so that it is firmly held axially by the stopper means.

20. An apparatus according to claim 19, wherein said member on which the bearing unit is loosely fit is the linearly moving member of the feed mechanism, and wherein said resilient means comprise a spacer member spaced from the stopper member on the linearly moving member, and a spring member urging the spacer member so that the bearing unit is axially and fixedly held between the stopper member and the spacer member.

21. An apparatus according to claim 20, wherein said resilient member is a Belleville spring inserted to the linearly moving member.

22. An apparatus according to claim 19, wherein said member on which the bearing unit is loosely fit is the timing piston, and wherein said resilient means comprise a wave-shaped annular spring arranged on the side of the bearing unit opposite to the stopper member on the timing piston.

23. An apparatus according to claim 14, wherein said rotary drive means comprise a rotating motor, and a gear connection between the motor and the rotating part of the feed mechanism.

24. An apparatus according to claim 23, wherein said gear connection comprises a worm member connected to the motor and a gear wheel in engagement with the worm member, and which is fixedly connected to the rotating part of the feed mechanism.

25. An apparatus according to claim 24, further comprising bearing members for rotatably supporting the feed mechanism at said housing at locations on respective sides of the worm wheel.

26. An apparatus for controlling a valve timing in an internal combustion engine, having an engine block, a crankshaft mounted to the engine block, a camshaft mounted to the engine block, and a power receiving member rotatably mounted on the camshaft for receiving a rotational movement of the crankshaft, said apparatus comprising:

a housing;

a first sleeve member fixedly connected to one end of the camshaft, the first sleeve member defining, at a cylindrical surface thereof, a helical spline;

a second sleeve member fixedly connected to the power receiving member;

a timing piston movable along the axis of the camshaft, the timing piston having a first helical spline portion engaging with the first sleeve member and a second spline portion engaging the second sleeve in such a manner that the axial movement of the timing piston causes a mutual angular positioning between the camshaft and the power receiving member to be obtained;

means for fixing the housing to the engine block;

rotary drive means for generating a rotating movement;

a feed mechanism having a rotating part rotatable with the housing and connected to said rotary drive means and a linearly moving part which is moved with respect to the housing along the axis of the camshaft upon the rotation of the rotating part, and;

means for connecting the linearly moving part with the timing piston so that the axial movement of the feed mechanism is transmitted to the timing piston during a rotation thereof, and a limited radial, relative movement is allowed between the linearly moving part and the timing piston;

said housing together with the timing piston, the feed mechanism and the connecting means constructing a sub-assembly connected to the engine block by said fixing means.

* * * * *